US010468205B2

(12) United States Patent
Campbell et al.

(10) Patent No.: US 10,468,205 B2
(45) Date of Patent: Nov. 5, 2019

(54) ELECTRICAL CONTACT ALLOY FOR VACUUM CONTACTORS

(71) Applicant: EATON CORPORATION, Cleveland, OH (US)

(72) Inventors: Louis Grant Campbell, Elmira, NY (US); Ganesh Kumar Balasubramanian, Horseheads, NY (US); Benjamin Alex Rosenkrans, Painted Post, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 76 days.

(21) Appl. No.: 15/377,258

(22) Filed: Dec. 13, 2016

(65) Prior Publication Data

US 2018/0166225 A1 Jun. 14, 2018

(51) Int. Cl.
*H01H 1/02* (2006.01)
*H01H 1/025* (2006.01)
(Continued)

(52) U.S. Cl.
CPC ..... *H01H 1/0206* (2013.01); *B22F 1/0003* (2013.01); *B22F 3/105* (2013.01); *B22F 3/1035* (2013.01); *B22F 3/15* (2013.01); *B22F 3/16* (2013.01); *B22F 3/24* (2013.01); *B22F 9/04* (2013.01); *C22C 9/00* (2013.01); *C22C 30/02* (2013.01); *C22C 32/0052* (2013.01);
(Continued)

(58) Field of Classification Search
CPC ..... H01H 1/0206; H01H 1/025; H01H 1/027; H01H 33/664; H01H 11/04; B22F 3/1035; B22F 3/105; B22F 3/15; B22F 9/04; C22C 9/00; C22C 30/02; C22C 32/0052; C22C 1/05
USPC ..... 218/123, 130, 132; 200/266; 75/247
See application file for complete search history.

(56) References Cited

U.S. PATENT DOCUMENTS 3,683,138 A * 8/1972 Nabae ..... H01H 1/0203 218/130
4,554,425 A * 11/1985 Kashiwagi ..... H01H 1/0206 200/262
(Continued)

FOREIGN PATENT DOCUMENTS

CN 105761956 * 7/2016 ..... C22C 9/00
DE 33 36 696 A1 4/1984
(Continued)

OTHER PUBLICATIONS

Translation CN105761956 (original document published Jul. 13, 2016) (Year: 2016).*
(Continued)

*Primary Examiner* — Truc T Nguyen
*Assistant Examiner* — William A Bolton
(74) *Attorney, Agent, or Firm* — Eckert Seamans Cherin & Mellott, LLC

(57) ABSTRACT

An improved electrical contact alloy, useful for example, in vacuum interrupters used in vacuum contactors is provided. The contact alloy according to the disclosed concept comprises copper particles and chromium particles present in a ratio of copper to chromium of 2:3 to 20:1. The electrical contact alloy also comprises particles of a carbide, which reduces the weld break strength of the electrical contact alloy without reducing its interruption performance.

20 Claims, 3 Drawing Sheets

(51) Int. Cl.

| | |
|---|---|
| ***H01H 1/027*** | (2006.01) |
| ***H01B 1/02*** | (2006.01) |
| ***B22F 3/15*** | (2006.01) |
| ***B22F 3/16*** | (2006.01) |
| ***B22F 3/10*** | (2006.01) |
| ***B22F 3/105*** | (2006.01) |
| ***B22F 3/24*** | (2006.01) |
| ***B22F 1/00*** | (2006.01) |
| ***B22F 9/04*** | (2006.01) |
| ***C22C 9/00*** | (2006.01) |
| ***C22C 30/02*** | (2006.01) |
| ***C22C 32/00*** | (2006.01) |

(52) U.S. Cl.

CPC ..... *H01B 1/026* (2013.01); *H01H 1/025* (2013.01); *H01H 1/027* (2013.01); *B22F 2003/1051* (2013.01); *B22F 2003/247* (2013.01); *B22F 2009/041* (2013.01); *B22F 2009/043* (2013.01); *B22F 2301/10* (2013.01); *B22F 2301/20* (2013.01); *B22F 2302/10* (2013.01); *B22F 2998/10* (2013.01)

(56) References Cited

U.S. PATENT DOCUMENTS

| | | | | |
|---|---|---|---|---|
| 4,686,338 | A * | 8/1987 | Kashiwagi | H01H 1/0206 200/262 |
| 4,687,515 | A * | 8/1987 | Talento | B22F 1/0003 75/246 |
| 4,766,274 | A * | 8/1988 | Iyer | B22F 1/0003 200/265 |
| 5,120,918 | A * | 6/1992 | Thomas | H01H 1/0206 218/130 |
| 5,304,330 | A * | 4/1994 | Tatarchuk | B22F 3/002 264/104 |
| 5,637,816 | A * | 6/1997 | Schneibel | C22C 29/00 75/240 |
| 7,662,208 | B2 * | 2/2010 | Kikuchi | H01H 1/0233 75/247 |
| 8,269,130 | B2 | 9/2012 | Mangan et al. | |
| 9,006,600 | B2 | 4/2015 | Leusenkamp et al. | |
| 2013/0199905 | A1 * | 8/2013 | Noda | C22C 1/0425 200/265 |

FOREIGN PATENT DOCUMENTS

| | | |
|---|---|---|
| DE | 199 32 867 A1 | 1/2001 |
| EP | 0 064 191 A1 | 11/1982 |

OTHER PUBLICATIONS

Qun Yan et al., An Investigation in CuCr Contact Materials with Low Chopping Current, School of Material Science and Engineering, 1995, pp. 237-241, Jiaotong University, China.

Li Zhenbiao et al., The Theoretical Prediction of Current Chopping Ability of Vacuum Contact Materials, Department of Electrical Power Engineering, Huazhong University of Science and Technology,1995, pp. 232-236, Wuhan, China.

Paul G. Slade, The Vacuum Interrupter, 1941, pp. 348-357, CRC Press, Florida.

Powder Processes, http://thelibraryofmanufacturing.com/powder_processes.html.

European Patent Office, International Search Report and Written Opinion (corresp. to PCT/US2017/065083), dated Apr. 24, 2018, 10 pp.

* cited by examiner

ELECTRICAL CONTACT ALLOY FOR VACUUM CONTACTORS

BACKGROUND

Field

The disclosed concept pertains generally to alloys, and more specifically to alloys for use in contacts for vacuum contactors.

Background Information

Vacuum circuit interrupters (e.g., without limitation, vacuum circuit breakers; vacuum switches; load break switches) provide protection for electrical systems from electrical fault conditions such as current overloads, short circuits, and low level voltage conditions, as well as load-break and other switching duties. Typically, vacuum circuit interrupters include a spring-powered or other suitable operating mechanism, which opens electrical contacts inside a number of vacuum interrupters to interrupt the current flowing through the conductors in an electrical system in response to normal or abnormal conditions. Vacuum contactors are a type of vacuum interrupter developed primarily to switch three-phase electric motors. In some embodiments, vacuum interrupters are used to interrupt medium voltage alternating current (AC) currents and, also, high voltage AC currents of several thousands of amperes (A) or more. In one embodiment, one vacuum interrupter is provided for each phase of a multi-phase circuit and the vacuum interrupters for the several phases are actuated simultaneously by a common operating mechanism, or separately or independently by separate operating mechanisms.

Vacuum interrupters generally include separable electrical contacts disposed within an insulated and sealed housing defining a vacuum chamber. Typically, one of the contacts is fixed relative to both the housing and to an external electrical conductor, which is electrically interconnected with a power circuit associated with the vacuum interrupter. The other contact is part of a movable contact assembly that may include a stem and a contact positioned on one end of the stem within the sealed vacuum chamber of the housing.

When the separable contacts are opened with current flowing through the vacuum interrupter, a metal-vapor arc is struck between contact surfaces, which continues until the current is interrupted, typically as the current goes to a zero crossing.

Vacuum interrupters are often used for applications where they are rated to operate at voltages of 500 to 40,000V, with switching currents up to 4000 A or higher, and maximum breaking currents up to 80,000 A or higher, and are expected to have a long operational life of 10,000 to over 1,000,000 mechanical and/or electrical cycles. Vacuum interrupters used in vacuum contactors are rated to operate at voltages of 480-15,000V, switching currents of 150-1400 A, and maximum breaking currents of 1500-14000 A. See P. G. Slade, The Vacuum Interrupter, Theory Design and Application, (pub. CRC Press) (2008) Sec. 5.4 at pp. 348-357. Vacuum interrupters for vacuum contactor duty also are expected to exhibit additional electrical properties, such as low chop current, low weld breaking force, and low contact erosion rates to give long electrical switching life often up to or exceeding 1,000,000 operating cycles.

Existing vacuum contactor contact alloys such as silver-tungsten carbide (AgWC) operate well in the lower currents, but are costly. Copper-tungsten carbide (CuWC) is a lower cost alternative, but has higher chop currents and is not commonly used. Both copper- and silver-tungsten carbide require either expensive external coils or expensive arc control magnetic contact designs to interrupt at higher ratings, such as 1000V 800-1400 A, 7200V 400-800 A and specialty applications where a contactor vacuum interrupter also serves circuit breaker duty. Copper-chromium-bismuth (CuCrBi) has been used for these ratings with better interruption, low chop, and low welding, but has shortened electrical life. Extruded copper-chromium (CuCr) has been applied successfully at these higher ratings (see, for example, European Patent publication EP 1130608), but has higher chop and more welding compared to silver-tungsten carbide or copper-chromium-bismuth.

SUMMARY

A contact alloy having improved interruption at the 400 A or higher vacuum contactor ratings, particularly at higher voltages, and that does not suffer from a shortened useful electrical life experienced with some conventional alloys is provided.

Various embodiments of improved contact alloys for use in electrical contacts are described herein. The improved contact alloys are useful for the demands of contact assemblies, such as, without limitation, vacuum interrupters.

As one aspect of the disclosed concept, an electrical contact alloy for use in vacuum interrupters is provided. In various embodiments, an alloy according to the disclosed concept comprises: copper particles and chromium particles. The ratio of copper to chromium relative to each other may range from 2:3 to 20:1 by weight. The electrical contact alloy also comprises particles of a carbide. The carbide may be present in an amount ranging from 0 to 73 wt. % relative to the alloy.

In various embodiments of the disclosed concept, the carbide may selected from transition metal carbides, and more particularly, from the group of metal carbides consisting of tungsten carbide, molybdenum carbide, vanadium carbide, chromium carbide, niobium carbide, and tantalum carbide, titanium carbide, zirconium carbide, and hafnium carbide. In various embodiments of the disclosed concept, the carbide may be a silicon carbide.

The alloy of the disclosed concept may be made by any suitable powder metal technique. In various embodiments, a method of making an electrical contact for use in a vacuum interrupter is provided. The method may comprise milling carbide particles to a desired size; providing copper and chromium particles; mixing the carbide particles with the copper and chromium particles, present in a ratio of copper to chromium at 2:3 to 20:1; pressing the mixture into a compact; and, sintering the compact by one of solid state sintering, liquid phase sintering, spark plasma sintering, vacuum hot pressing, and hot isostatic pressing.

BRIEF DESCRIPTION OF THE DRAWINGS

The characteristics and advantages of the present disclosure may be better understood by reference to the accompanying figures.

DESCRIPTION OF THE PREFERRED EMBODIMENTS

Figure 1:
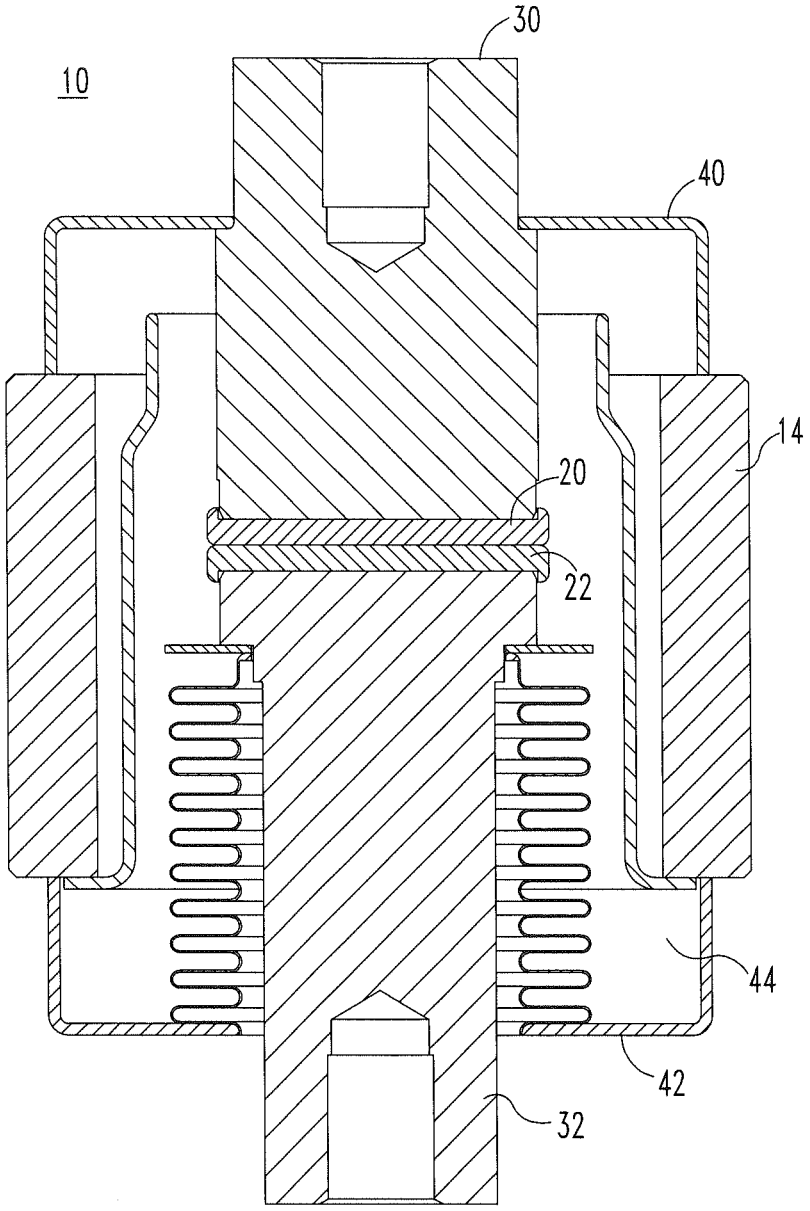
FIG. 1 is a cross-section of an aspect of a vacuum interrupter for use in a vacuum contactor, like that of FIG. 2.

As used herein, the singular form of "a", "an", and "the" include the plural references unless the context clearly dictates otherwise.

Directional phrases used herein, such as, for example and without limitation, top, bottom, left, right, lower, upper, front, back, and variations thereof, shall relate to the orientation of the elements shown in the drawings and are not limiting upon the claims unless otherwise expressly stated.

In the present application, including the claims, other than where otherwise indicated, all numbers expressing quantities, values or characteristics are to be understood as being modified in all instances by the term "about." Thus, numbers may be read as if preceded by the word "about" even though the term "about" may not expressly appear with the number. Accordingly, unless indicated to the contrary, any numerical parameters set forth in the following description may vary depending on the desired properties one seeks to obtain in the compositions and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Figure 2:
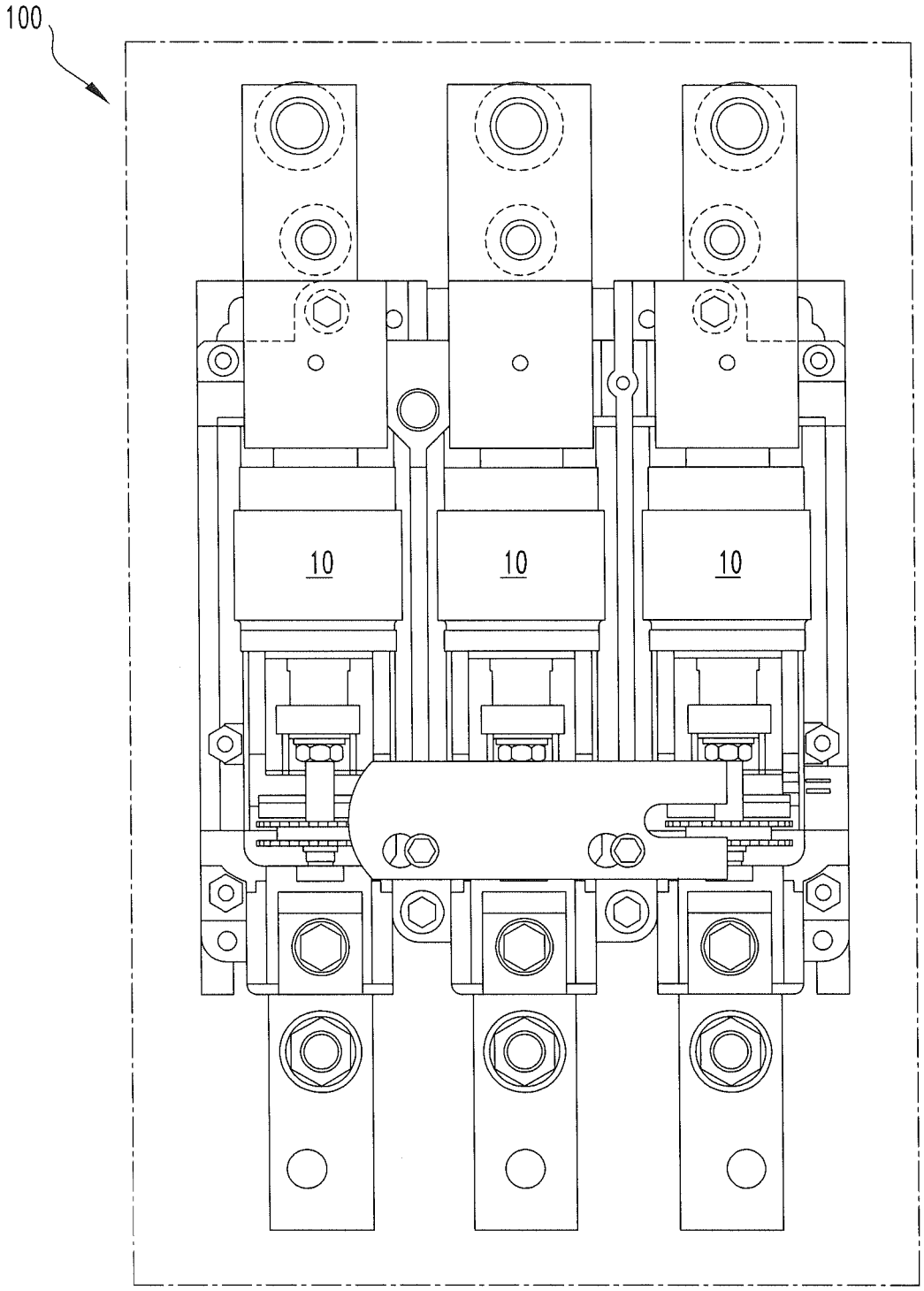
FIG. 2 is a schematic view a vacuum contactor and its vacuum interrupters.

An exemplary vacuum interrupter 10 is shown in FIG. 1, as an example of the interrupter useful in a three phase vacuum contactor 100, shown in FIG. 2. In the embodiment shown, the vacuum interrupter includes an insulating tube 14, such as a ceramic tube, which with end members 40 and 42 (e.g., without limitation, seal cups) form a vacuum envelope 44. A fixed contact 20 is mounted on a fixed electrode 30, which extends through the end member 40. A movable contact 22 is carried by the movable electrode 32 and extends through the other end member 42. The fixed contact 20 and movable contact 22 form separable contacts, which when closed, complete an electrical circuit between the fixed electrode 30 and the movable electrode 32, and when opened by axial movement of the movable electrode 32 interrupt current flowing through the vacuum interrupter 10. The movable electrode 32 is moved axially to open and close the separable contacts 20/22 by an operating mechanism (not shown) connected to the movable electrode 32 outside of the vacuum envelope 44.

The contacts 20/22 are made of the improved alloy of the concept disclosed herein. The improved contact alloy is a copper-chromium X-carbide (CuCrXC), wherein X is preferably a metal or semi-metallic element, more preferably a transition metal, and most preferably a metal selected from Groups 4, 5 and 6 of the Periodic Table of the Elements. Exemplary metals for forming the metal carbide include titanium (Ti), zirconium (Zr), Hafnium (Hf), tungsten (W), molybdenum (Mo), vanadium (V), chromium (Cr), niobium (Nb) and tantalum (Ta).

A carbide is any of a class of chemical compounds in which carbon is combined with an electropositive element, such as a metal or semi-metallic element. There are three broad classifications of carbides based on their properties. The most electropositive metals form ionic or salt-like carbides, the Group 4, 5 and 6 transition metals in the middle of the Periodic Table of the Elements, tend to form what are called interstitial carbides, and the nonmetals of electronegativity similar to that of carbon form covalent or molecular carbides. Interstitial carbides combine with transition metals and are characterized by extreme hardness and brittleness, and high melting points (typically about 3,000-4,000° C. [5,400-7,200° F.]). They retain many of the properties associated with the metal itself, such as high conductivity of heat and electricity. The interstitial carbide forming transition metals include titanium (Ti), zirconium (Zr), Hafnium (Hf), tungsten (W), molybdenum (Mo), vanadium (V), chromium (Cr), niobium (Nb) and tantalum (Ta). Silicon carbide may also be used.

Exemplary contact alloys of the disclosed concept include CuCrWC, or CuCrMoC, or CuCrVC, or CuCrCrC, or CuCrNbC, or CuCrTaC.

The alloy of the disclosed concept capitalizes on the good current interruption of copper-chromium and, at least in one exemplary embodiment, the low weld-breaking force of a tungsten carbide. The alloy of the disclosed concept may be tailored to control the microstructure of the alloy and the density of the contact 20/22 made with the alloy.

In various embodiments, the copper particles are present in an amount ranging from 40 wt. % to 90 wt. %. In various embodiments, the chromium particles are present in an amount ranging from 60 wt. % to 10 wt. %. In various embodiments, the metal carbide particles are present in an amount ranging from 0 wt. % to 73 wt. %. Relative to each other, the ratio of copper to chromium particles ranges from 2:3 to 20:1 by weight, with a preferred ratio of Cu:Cr at 55:45 by weight for use in vacuum contactor applications. Table 1 shows the weight and volume percentage compositions of a control having no carbide added, and three samples of mixtures of the identified particles used to form embodiments of the alloys of the disclosed concept wherein the metal carbide was tungsten carbide (WC).

TABLE 1

| Alloy | A | B | C | D |
|---|---|---|---|---|
| Cu wt % | 55 | 53.9 | 52.4 | 49.9 |
| Cr wt % | 45 | 44.1 | 42.9 | 40.8 |
| WC wt % | 0 | 1.9 | 4.8 | 9.3 |
| Cu Vol % | 49.4 | 48.9 | 48.2 | 46.9 |
| Cr Vol % | 50.6 | 50.1 | 49.3 | 48.1 |
| WC Vol % | 0 | 1 | 2.5 | 5 |

The addition of carbide particles to the copper and chromium is believed to increase the brittleness of the alloy, which reduces the force needed to break welds that may form between the adjacent contacts from the heat generated when high current flows through the contacts. Increasing brittleness changes the strength of the alloy so that the force needed to separate the adjacent contacts is reduced, such that the contacts are separably engaged, more like adjacent sides of fabric held together by a zipper rather than an inseparable seam.

Unlike prior alloys, such as copper-chromium-bismuth (CuCrBi), which was also brittle, the embodiments of the alloy of the disclosed concept do not emit high quantities of metal during arcing that then coat the ceramic housing converting a structure that is designed to insulate into a conductor, thereby reducing the overall electrical life of the vacuum interrupter.

By tailoring the copper-chromium ratio, the metal carbide particle size, the relative amount of the metal carbide, and the distribution and placement of the carbide particles within the copper chromium matrix, the alloy of the disclosed concept can be optimized for a given contactor rating or desired application.

For applications where greater conductivity is desired, the amount of copper may be increased. For applications where the strength of the finished contact must be tougher or weaker, the amount of carbide would be decreased or increased. If it is desirable to decrease the weld strength, the amount of either or both chromium or carbide may be increased, within the ranges disclosed herein. If it is desirable to reduce the chop current, the amount of carbide can be increased, within the ranges disclosed herein.

The contact alloy may be made by any suitable known powder metal process, including, without limitation, solid state sintering, liquid phase sintering, spark plasma sintering, vacuum hot pressing, and hot isostatic pressing. The powder metallurgy press and sinter process generally consists of three basic steps: powder blending, die compaction, and sintering. Compaction is generally performed at room temperature, and the elevated-temperature process of sintering in high vacuum or at atmospheric pressure and under carefully controlled atmosphere composition. Optional secondary processing such as coining or heat treatment may follow to obtain special properties or enhanced precision.

For example, the alloys set forth in Table 1 were prepared using a liquid phase press and sinter process. Elemental powders of the compositions listed in Table 1 were mixed in a ribbon blender, gravity fed into a die cavity, and compacted at a pressure of 44 to 48 tons per square inch on a hydraulic powder compaction press. Compacts thus formed were packed into cups under aluminum oxide powder then loaded into a vacuum sintering furnace. The vacuum sintering furnace heated them to a temperature of 1185° C. at a vacuum level of 8E−5 torr or lower, vacuum cooled the parts to 500° C., and then force cooled the parts to room temperature using partial pressure nitrogen. After unloading, the sintered parts were dry machined to the final contact shape, then brazed into vacuum interrupters.

In an exemplary solid state powder metallurgy process, a pre mixed metal powder is fed, typically by gravity feed, into a die cavity, and compacted, in most cases to the components final net shape, and then ejected from the die. The force required to compact the parts to size is typically around 15-50 tons per square inch. Next, the parts are loaded into a vacuum sintering furnace that heads the parts under vacuum levels of 1E−4 torr or lower until it reaches the temperature necessary for sintering and bonding of the particles, in the case of the alloy of the concept disclosed herein the temperature is near but not greater than the lowest melting point of the elements making up the particles, such as 1050° C. in this exemplary case. The bonded particles are then cooled under vacuum to a temperature of 500° C., then force cooled with circulated nitrogen gas at partial pressure until the parts reach room temperature before unloading the furnace.

In an exemplary liquid phase sintering powder metallurgy process, a pre mixed metal powder is fed, typically by gravity feed, into a die cavity, compacted, then ejected from the die. The force required to compact the parts to size is typically around 15-50 tons per square inch. Next, the parts are loaded into a vacuum sintering furnace that heads the parts under vacuum levels of 1E−4 torr or lower until it reaches the temperature necessary for sintering and bonding of the particles, in the case of liquid phase sintering the alloy of the concept disclosed herein the temperature is greater than the lowest melting point of the elements making up the particles, such as at least greater than 1074° C. The bonded particles are then cooled under vacuum to a temperature of 500° C., then force cooled with circulated nitrogen gas at partial pressure until the parts reach room temperature before unloading the furnace.

In an exemplary spark plasma sintering process, a mixed metal powder of the alloy of the concept disclosed herein is loaded into a die. Direct current (DC) is then pulsed directly through the graphite die and the powder compact in the die, under a controlled partial pressure atmosphere. Joule heating has been found to play a dominant role in the densification of powder compacts, which results in achieving near theoretical density at lower sintering temperature compared to conventional sintering techniques. The heat generation is internal, in contrast to the conventional hot pressing, where the heat is provided by external heating elements. This facilitates a very high heating or cooling rate (up to 1000 K/min), hence the sintering process generally is very fast (within a few minutes). The general speed of the process ensures it has the potential of densifying powders with nanosize or nanostructure while avoiding coarsening which may accompany standard densification routes.

An exemplary vacuum hot pressing process includes loading a mixed metal powder of the alloy of the concept disclosed herein into a die, loading the die into a vacuum hot press which can apply uniaxial force to the loaded die under high vacuum and high temperatures. The die can be a multicavity die to increase production rates. The loaded die is then heated to 1868° F. (1020° C.) at vacuum levels of 1E−4 torr or lower, and a pressure of 2.8 tons per square inch of compact is applied to the die. This condition is held for 10 minutes. The die and powder compacts is then cooled under vacuum to 500° C., then force cooled with circulated nitrogen gas at partial pressure until the parts reach room temperature and are unloaded In an exemplary hot isostatic pressing process the particles are compressed and sintered simultaneously by applying an external gas pressure of about 100 MPa (1000 bar, 15,000 psi) for 10-100 minutes, and applying heat ranging, typically from 900° F. (480° C.) to 2250° F. (1230° C.), but in the processing of the alloy of the disclosed concept, heating to temperatures ranging from 1652° F. (900° C.) to 1965° F. (1074° C.). The furnace is filled with Argon gas or another inert gas to prevent chemical reactions during the operation.

To increase control the densities of the alloy blanks or the contacts formed from the selected shaping process, a sintering activation element may be added to the mixture further processing. The activation element need be added in relatively small amounts compared to the principal components of copper, chromium, and the metal carbide. It is believed that less than 0.5 wt. % and in various embodiments, less than 0.1 wt. % activation element need be added to obtain the desired density levels. The precise amount will vary, as can be easily determined by those skilled in the art, depending on the desired density of the final product. Exemplary activation elements include iron-nickel, iron aluminide, nickel, iron, and cobalt, often added in amounts of 0.1 to 60 wt % of the carbide component. The sintering activation element increases density by forming a transient or persistent liquid phase with the carbide that allows it to sinter to a higher density at a lower temperature than would be present without it. Those skilled in the art will appreciate that other activation elements or alloys may be used in the mixture.

The contacts can be formed from the alloy made as described herein, from a machinable blank or net shape or near-net shaped parts by pressing, powder extrusion, metal injection or similar processes.

A method for making a contact, such as a contact for use in a vacuum interrupter includes generally milling carbide particles to a desired size, providing copper and chromium particles that are larger in size than the milled carbide particles, mixing milled carbide particles with the copper and chromium particles, pressing the mixture into a compact; and, heating the compact to a temperature appropriate to a sintering process selected from the group consisting of: solid state sintering, liquid phase sintering, spark plasma sintering, vacuum hot pressing, and hot isostatic pressing, such that the compact attains the density, strength, conductivity and other properties suitable for use as a vacuum interrupter contact.

In the method described above, the copper and chromium particles are present in a ratio of copper to chromium at 2:3 to 9:1, preferably a ratio of 11:9.

In an embodiment of the alloy wherein copper is the element of the mixture having the lowest melting point, the heating step is carried out at a temperature greater than 1074° C., and preferably to a temperature greater than between 1074° C. up to 1200° C., and more preferably to a temperature of 1190° C.

To increase the final part density, a sinter activation element may be added to the mixture to increase the density of the compact upon heating. Suitable sinter activation elements include cobalt, nickel, nickel-iron, iron aluminide, and combinations thereof.

An exemplary process for forming contacts for use in vacuum interrupters proceeds as follows. Mix tungsten carbide powder with 2.3 wt % iron aluminide powder where aluminum comprises 24.4 wt % of the iron aluminide. Rod mill the mixture to deagglomerate the carbide and disperse the activator. Mix 9.3 wt % of the rod milled carbide/activator mixture with copper and chromium powders where the copper:chromium weight ratio is 55:45 until homogenous. The composition of each component in the resultant powder mixture is then 49.8 wt % copper, 40.7 wt % chromium, 9.3 wt % tungsten carbide, and 0.2 wt % iron aluminide. Fill this mixed powder into a die cavity, and then compress the mixed powder into a compact by applying 48 tons per square inch of pressure with a compaction press to form a compact. Pack the compact under aluminum oxide powder, then load into a vacuum sintering furnace. Vacuum sinter the compact at a vacuum level of 8E−5 torr or lower at a temperature of 1190° C. for 5 hours, vacuum cool the parts to 500° C., and force cool the parts to room temperature under partial pressure nitrogen. Unload the furnace, and dry machine the sintered blank into the contact final shape. Braze the machined contact into a vacuum interrupter.

Tests were conducted to demonstrate the improved properties of the alloy according to the disclosed concept. Embodiments of the alloy of the disclosed concept were compared to AgWC, CuWC, and CuCr alloys heretofore used in electrical contacts.

The alloys set forth in Table 1 were prepared using a liquid phase press and sinter process. Elemental powders of the compositions listed in Table 1 were mixed in a ribbon blender, gravity fed into a die cavity, and compacted at a pressure of 44 to 48 tons per square inch on a hydraulic powder compaction press. Compacts thus formed were packed into cups under aluminum oxide powder then loaded into a vacuum sintering furnace. The vacuum sintering furnace heated them to a temperature of 1185° C. at a vacuum level of 8E−5 torr or lower, vacuum cooled the parts to 500° C., and then force cooled the parts to room temperature using partial pressure nitrogen. After unloading, the sintered parts were dry machined to the final contact shape, a simple disc geometry with a diameter of Ø 0.92 inches and a thickness of 0.1 inches.

Contacts thus manufactured were brazed into a vacuum interrupter, product type WL-36327, with a 2" envelope diameter, shown schematically in FIG. 2. This product is typically rated for vacuum contactor applications per IEC 60470 and 62271-1 and UL 347, with a maximum line voltage of 1.5 $k_{rms}$, rated continuous current of 400 $A_{rms}$, maximum short circuit breaking current of 4 $kA_{rms}$, a peak withstand current of 15.6 $kA_{peak}$ at 60 Hz and 52 lbs. of applied force. The assembled vacuum interrupters were tested for weld strength and short circuit interruption, along with identical "control" vacuum interrupters made with silver tungsten carbide contacts with a composition of 58.5 wt % tungsten carbide, 40 wt % silver, and 1.5 wt % cobalt.

Figure 3:
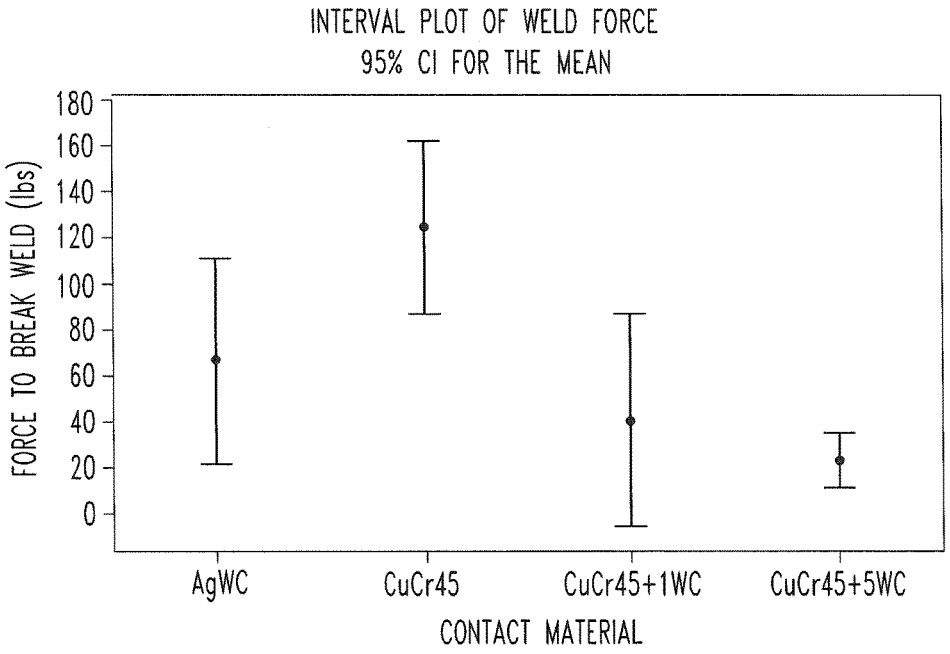
FIG. 3 is an interval plot of weld force showing the force to break weld data ranges and averages for several test materials.

Vacuum interrupters were evaluated for interruption performance and weld break strength at the High Power Laboratory at Eaton Corporation's Horseheads, N.Y. manufacturing facility. The comparative interruption test consisted of 50 single phase trials to interrupt at a rating of 1.5 $kV_{rms}$ 4 $kA_{rms}$: this test was applied to at least two vacuum interrupters per contact alloy. Weld break strength tests consisted of creating a weld by applying 1 full 60 Hz cycle of 15.6 kA peak AC current to the test vacuum interrupter with a contact force of 14.9 lbs. including atmospheric bellows force. The formed weld was then taken to a pull apparatus equipped with a force transducer, and the force required to open the contacts recorded. FIG. 3 shows the data points for each material tested. The average weld break strengths and the interruption current results are given in Table 2.

TABLE 2

TEST RESULTS

| Contact Alloy | Normal Arc Time Trials/Attempted 1.5 kV 4 kA 50 Hz | Average Weld Break Force After 1 cycle 15.6 $kA_{peak}$ with 14.9 lbs. contact force |
|---|---|---|
| CuCr45 + 5WC | 100/100 = 100% | 22 lbs. |
| CuCr45 + 1WC | 100/100 = 100% | 40 lbs. |
| CuCr45 | 149/150 = 99% | 125 lbs. |
| AgWC | 147/150 = 98% | 67 lbs. |

As can be seen from the results in Table 2, the addition of carbide to the CuCr45 alloy significantly decreased the weld break force without reducing interruption performance, providing an improved electrical contact for use in vacuum interrupters intended for vacuum contactor duty.

The present invention has been described with reference to various exemplary and illustrative embodiments. The embodiments described herein are understood as providing illustrative features of varying detail of various embodiments of the disclosed invention; and therefore, unless otherwise specified, it is to be understood that, to the extent possible, one or more features, elements, components, constituents, ingredients, structures, modules, and/or aspects of the disclosed embodiments may be combined, separated, interchanged, and/or rearranged with or relative to one or more other features, elements, components, constituents, ingredients, structures, modules, and/or aspects of the disclosed embodiments without departing from the scope of the disclosed invention. Accordingly, it will be recognized by persons having ordinary skill in the art that various substitutions, modifications or combinations of any of the exemplary embodiments may be made without departing from the scope of the invention. In addition, persons skilled in the art will recognize, or be able to ascertain using no more than routine experimentation, many equivalents to the various embodiments of the invention described herein upon review of this specification. Thus, the invention is not limited by the description of the various embodiments, but rather by the claims.

What is claimed is:

1. An electrical contact alloy comprising:
a homogenous mixture of copper particles;
chromium particles;
wherein the copper particles to chromium particles relative to each other have a weight ratio of 55:45;
particles of a carbide present in an amount ranging from 0 to 73 wt. % relative to the alloy; and
sintering activation elements present in an amount less than 0.5 wt. % to increase density.

2. The alloy recited in claim 1 wherein the carbide is selected from the group of silicon carbides and metal carbides.

3. The alloy recited in claim 2 wherein the metal carbides are selected from the group consisting of tungsten carbide, molybdenum carbide, vanadium carbide, chromium carbide, niobium carbide, and tantalum carbide, titanium carbide, and hafnium carbide.

4. The alloy recited in claim 1 wherein the sintering activation elements are selected from the group consisting of cobalt, nickel, nickel-iron, and iron aluminide.

5. The alloy recited in claim 1 wherein the carbide is tungsten carbide.

6. The alloy recited in claim 1 wherein the carbide is molybdenum carbide.

7. The alloy recited in claim 1 wherein the carbide is vanadium carbide.

8. The alloy recited in claim 1 wherein the carbide is niobium carbide.

9. The alloy recited in claim 1 wherein the carbide is tantalum carbide.

10. The alloy recited in claim 1 wherein the carbide is chromium carbide.

11. The alloy recited in claim 1 wherein the carbide is titanium carbide.

12. The alloy recited in claim 1 wherein the carbide is hafnium carbide.

13. The alloy recited in claim 1 wherein the chromium is present in an amount ranging from 5 to 60 wt. % relative to copper, the balance being copper.

14. An electrical contact for use in a vacuum interrupter comprising:
an electrically conductive contact member formed from an alloy comprised of:
a homogenous mixture of copper particles and chromium particles, wherein the copper particles to chromium particles have a weight ratio relative to each other of 55:45;
particles of a carbide present in an amount ranging from 0 to 73 wt. % relative to the alloy; and
sintering activation elements present in an amount less than 0.5 wt. % to increase density.

15. The contact recited in claim 14 wherein the carbide is selected from the group consisting of silicon carbide, tungsten carbide, molybdenum carbide, vanadium carbide, chromium carbide, niobium carbide, tantalum carbide, titanium carbide, and hafnium carbide.

16. An electrical contact alloy comprising:
a homogenous mixture of copper particles;
chromium particles;
wherein the copper particles to chromium particles have a weight ratio relative to each other ranging from 2:3 to 20:1 by weight;
particles of a carbide present in an amount ranging from 0 to 73 wt. % relative to the alloy; and,
sintering activation elements present in an amount less than 0.5 wt. % to increase density.

17. The alloy recited in claim 16 wherein the sintering activation elements are selected from the group consisting of cobalt, nickel, nickel-iron, and iron aluminide.

18. The alloy recited in claim 16 wherein the carbide is selected from the group of silicon carbides and metal carbides.

19. The alloy recited in claim 18 wherein the metal carbides are selected from the group consisting of tungsten carbide, molybdenum carbide, vanadium carbide, chromium carbide, niobium carbide, and tantalum carbide, titanium carbide, and hafnium carbide.

20. The alloy recited in claim 16 wherein the chromium is present in an amount ranging from 5 to 60 wt. % relative to copper, the balance being copper.

* * * * *